US005620183A

United States Patent [19]

Skratulia

[11] Patent Number: 5,620,183

[45] **Date of Patent: *Apr. 15, 1997**

[54] SET OF DICE FOR PRODUCING A RANGE OF NUMERICAL VALUES AND METHOD OF USE

[76] Inventor: John Skratulia, 11402 Howard St., Whittier, Calif. 90601

[ * ] Notice: The term of this patent shall not extend beyond the expiration date of Pat. No. 5,607,161.

[21] Appl. No.: 532,302

[22] Filed: Sep. 22, 1995

[51] Int. Cl.[6] ..... A63F 9/04

[52] U.S. Cl. ..... 273/146; 273/274

[58] Field of Search ..... 273/146, 138, 273/268, 274, 142 E

[56] References Cited

U.S. PATENT DOCUMENTS 4,743,025 5/1988 Gramera ..... 273/146

FOREIGN PATENT DOCUMENTS 213695 2/1955 Australia ..... 273/146
510065 2/1955 Canada ..... 273/146

OTHER PUBLICATIONS

"Mathematical Dice", Scientific American, Dec. 1970.

*Primary Examiner*—William M. Pierce
*Attorney, Agent, or Firm*—Timothy T. Tyson; Ted Masters

[57] ABSTRACT

A set of dice (20, 120) for producing a range of numerical values includes a plurality of diced each having a representation of a selected number disposed on each of its six sides. In one embodiment the set of dice 20 includes first die 22, second die 24, and third die 26, and the range of numerical values produced is one through eight. In a second embodiment the set of dice 120 includes first die 122 and second die 124, and the range of numerical values produced is one through nine.

4 Claims, 1 Drawing Sheet

SET OF DICE FOR PRODUCING A RANGE OF NUMERICAL VALUES AND METHOD OF USE

TECHNICAL FIELD

The present invention pertains generally to wagering games and more particularly to a special set of dice for producing a range of numerical values and method of uses wherein each numerical value within the range has an equal probability of being produced.

BACKGROUND ART

Dice in various forms are utilized in a multitude of games. For example, in many casino wagering games it is commonplace to utilized dice to determine the player or playing position at the table where play commences (known as the "action player" or "action position"). Depending upon the specific gamer the action player is typically the first to receive cards, and is also the first to have his or her bet dispositioned. Three conventional dice are utilized to determine the action player. The dice are usually rolled by the player-bankers with a resulting numerical total ranging from 3 through 18 (sixteen numbers). Commencing with the player-bankers the numeric total of the three dice is then sequentially counted off clockwise, thereby establishing the action player. For example, in an eight handed game wherein player six was the player-banker, a dice roll of 13 would establish player 2 as the action player (6,7,8,1,2,3,4,5,6,7, 8,1,2). This technique is somewhat cryptic in that the action player is not directly defined, but rather cumbersome and time consuming counting is required. A second disadvantage of the three conventional dice method is that the probability of all players becoming the action player is not equal. There are 216 (6×6×6) possible combinations of three dice. In an eight handed game, the probabilities of each player becoming the action player are as follows:

Player 1 28/216=0.130

Player 2 28/216=0.130

Player 3 28/216=0.130

Player 4 28/216=0.130

Player 5 27/216=0.125

Player 6 25/216=0.116

Player 7 25/216=0.116

Player 8 27/216=0.125

While the variation among players is not extreme, it would nevertheless be preferable to utilize a system wherein the probabilities for each player are identical.

Another disadvantage of the three conventional dice method resides in the fact that the dice can never sum to one or two. Therefore, no matter where the count is initiated (e.g. the last winner of the previous hand), the first two sequential players can never become the action player on the first round of counting.

DISCLOSURE OF INVENTION

The present invention is directed to a special set of dice for producing a range of numerical values. The present invention overcomes the aforementioned disadvantages of the conventional three dice method of determining an action player by (1) providing a direct indication of which player or playing position is the action player without resorting to counting, and (2) assuring that the probability of each player becoming the action player is equal.

In accordance with a preferred embodiment, a plurality of dice each have a representation of a selected number disposed on each of their six sides. At least one of the dice include a representation of zero disposed on at least two of its six sides. The range of numerical values is defined by the numerical total of the plurality of dice after the dice are rolled. Each numerical value within the range of numerical values has an equal probability of being produced.

In accordance with an important feature of one embodiment of the invention, the set of dice includes three dice and the range of numerical values produced is one through eight.

In accordance with an important feature of the invention the three dice include a first die having zero disposed on three sides and two disposed on three sides; a second die having one disposed on three sides and two disposed on three sides; and a third die having zero disposed on three sides and four disposed on three sides.

In accordance with another important feature of the invention, the probability of any of the numbers one through eight being produced is 0.125.

In accordance with an important feature of a second embodiment of the invention, the set of dice includes two dice and the range of numerical values produced is one through nine.

In accordance with an important feature of the invention the two dice include a first die having one disposed on two sides, two disposed on two sides, and three disposed on two sides; and, a second die having zero disposed on two sides, three disposed on two sides, and six disposed on two sides.

In accordance with another important feature of the invention, the probability of any of the numbers one through nine being produced is 0.111.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
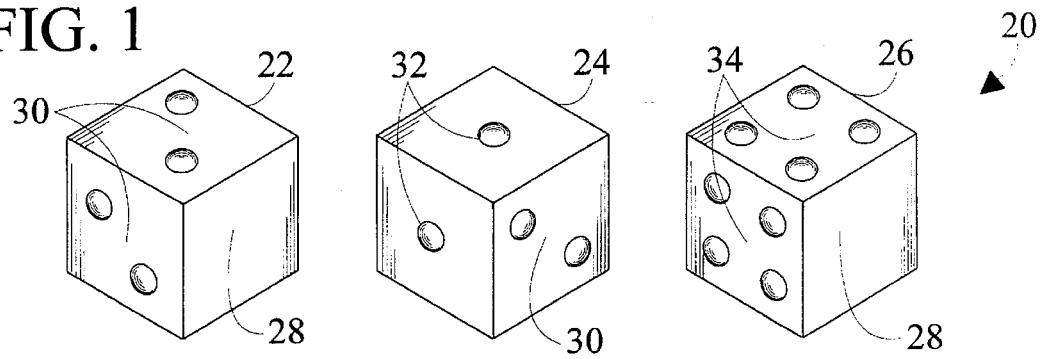
FIG. 1 is a perspective front view of a set of dice which produce a range of numerical values one through eight.
Figure 2:
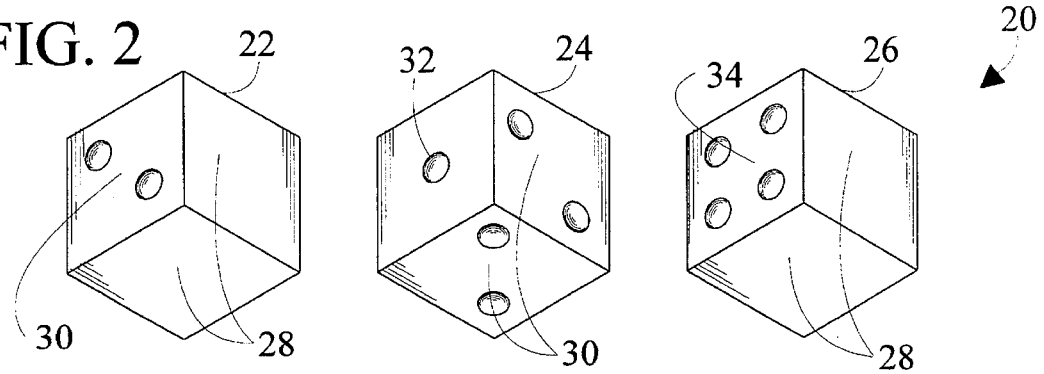
FIG. 2 is a perspective back view of the set of dice of FIG. 1.

Referring initially to FIGS. 1 and 2, there are depicted perspective front and back views of a set of dice which produce a range of numerical values one through eight, generally designated as 20. The range of numerical values produced is the numerical total of the uppermost side of the set of dice 20 after the dice are rolled. The plurality of dice 20 each have a representation of a selected number (including zero) disposed on each of its six sides. In the embodiment shown, the set of dice 20 includes a first die 22, a second die 24, and a third die 26. First die 22 has a representation of the number zero 28 (blank in the shown embodiment) disposed on three of its sides, and a representation of the number two 30 disposed on three of its sides.

Second die 24 has a representation of the number one 32 disposed on three of its sides, and a representation of the number two 30 disposed on three of its sides. Third die 26 has a representation of the number zero 28 disposed on three of its sides, and a representation of the number four 34 disposed on three of its sides. As is the case for conventional dice, in the shown embodiment dots are used to represent the selected numbers. However, other representations such as lines, numerals, or even written words could also be employed.

Table 1 illustrates all possible combinations of numerical values produced by the set of dice 20. It is noted that the range of numerical values produced is one through eight, and that each numerical value within the range has an equal 0.125 probability of being produced. This feature of the present invention is in marked contrast to a set of three conventional dice, wherein, depending upon the number of players, the probability of producing a given number may vary, and furthermore not all numbers have an equal probability of being produced.

An important aspect of the present invention is the fact that the set of dice 20 gives a direct indication of

TABLE 1

| First Die | Second Die | Third Die | Numerical Value Produced |
|---|---|---|---|
| 0(blank) | 1 | 0 | 1 |
| 0 | 1 | 4 | 5 |
| 0 | 2 | 0 | 2 |
| 0 | 2 | 4 | 6 |
| 2 | 1 | 0 | 3 |
| 2 | 1 | 4 | 7 |
| 2 | 2 | 0 | 4 |
| 2 | 2 | 4 | 8 |

TABLE 2

| First Die | Second Die | Numerical Value Produced |
|---|---|---|
| 1 | 0(blank) | 1 |
| 1 | 3 | 4 |
| 1 | 6 | 7 |
| 2 | 0 | 2 |
| 2 | 3 | 5 |
| 2 | 6 | 8 |
| 3 | 0 | 3 |
| 3 | 3 | 6 |
| 3 | 6 | 9 |

the selected player or playing position, and additionally that the numerical total of the set of dice 20 can never exceed eight. For example, in an eight handed game if the numerical total of the set of dice 20 is three, then the third player or playing position is selected. Conversely, with three conventional dice one and two can never be rolled, and counting must be performed if the rolled number exceeds eight.

The set of dice 20 are best used in games having exactly eight players. However, the set of dice 20 may also effectively be used in games having less than eight players. In such instances, if the number of an unoccupied playing position is produced, then the next sequential player becomes the action player. Alternatively, the dice are simply re-rolled until an occupied playing position is produced.

The method for producing a range of numerical values from one through eight consists simply of the providing the set of three dice 20, and rolling the three dice to produce one of the numbers one through eight.

It may be appreciated that objects other than dice could be used to accomplish the action hand selection for a numerical range of one through eight. For example, three coins could be used with a first coin having a blank on one side and a two on the opposite side, a second coin having a one on one side and a two on the opposite side, and a third coin having a blank on one side and a four on the opposite side.

Figure 3:
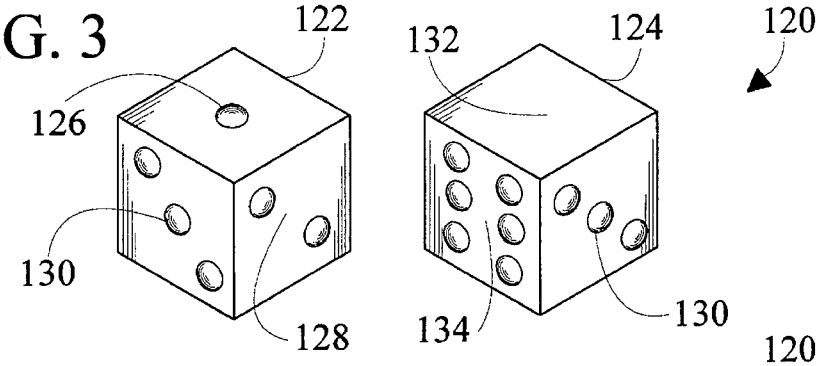
FIG. 3 is a perspective front view of a second embodiment set of dice which produce a range of numerical values one through nine; and, FIG. 4 is a perspective back view of the set of dice of FIG. 2.
Figure 4:
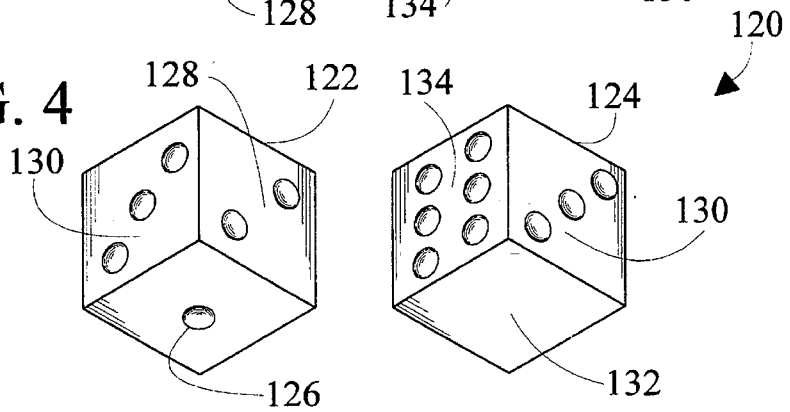

Referring now to FIGS. 3 and 4, there are depicted perspective front and back views of a second embodiment set of dice which produce a range of numerical values one through nines generally designated as 120. The plurality of dice 120 each have a representation of a selected number (including zero) disposed on each of its six sides. In the embodiment shown, the set of dice 120 includes a first die 122 and a second die 124. First die 122 has a representation of the number one 126 disposed on two of its sides, a representation of the number two 128 disposed on two of its sides, and a representation of the digit three 130 disposed on two of its sides. Second die 124 has a representation of the number zero 132 disposed on two of its sides, a representation of the number three 130 disposed on two of its sides, and a representation of the number six 134 disposed on two of its sides.

Table 2 illustrates all possible combinations of numerical values produced by the set of dice 120. It is noted that the range of numerical values produced is one through nine, and that each numerical value within the range has an equal 0.111 probability of being produced. This embodiment is best utilized in games having exactly nine players, however, the set of dice 120 may also effectively be used in games having less than nine players. In such instances, if the number of a nonexistent player or unoccupied playing position is produced, then the dice are simply re-rolled until the number of a player or occupied playing position is produced.

The method for producing a range of numerical values from one through nine consists simply of the providing the set of two dice 120, and rolling the two dice to produce one of the numbers one through nine.

It is noted that at least one of the dice in both embodiments 20 and 120 have the number zero 28,132 disposed on at least two of the six sides.

The present invention focuses upon using the special set of dice in the determination of an action player in casino gambling games. It may be appreciated however, that the same eight and nine range embodiments could also be used wherever it is necessary to randomly select one number from the range, and have an equal probability of producing any number within the range.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. A method for randomly generating one of the numbers one through eight, with each number one through eight having an equal 0.125 probability of being generated, comprising the steps of:

providing first, second, and third six-sided dice, said first die having a representation of the number zero disposed on three sides and a representation of the number two disposed on three sides; said second die having a representation of the number one disposed on three sides and a representation of the number two disposed on three sides; and, said third die having a representation of the number zero disposed on three sides and a representation of the number four disposed on three sides;

rolling said first, second, and third six-sided dice, after rolling said first, second, and third six-sided dice, each die having an uppermost side; and, numerically totaling said uppermost sides of said first, second, and third six-sided dice.

2. A method for randomly generating one of the numbers one through nine, with each number one through nine having an equal 0.111 probability of being generated, comprising the steps of:

providing first and second six-sided dice, said first die having a representation of the number one disposed on two sides, a representation of the number two disposed on two sides, and a representation of the number three disposed on two sides; and, said second die having a representation of the number zero disposed on two sides, a representation of the number three disposed on two sides, and a representation of the number six disposed on two sides;

rolling said first and second six-sided dice, after rolling said first and second six-sided dice, each die having an uppermost side; and, numerically totaling said uppermost sides of said first and second six-sided dice.

3. A set of three six-sided dice, comprising:

a first die having a representation of the number zero disposed on three sides and a representation of the number two disposed on three sides;

a second die having a representation of the number one disposed on three sides and a representation of the number two disposed on three sides;

a third die having a representation of the number zero disposed on three sides and a representation of the number four disposed on three sides; and, wherein if said three dice are rolled, the resulting numerical total of said three dice being one of the numbers one through eight, with each number one through eight having an equal 0.125 probability of being produced.

4. A set of two six-sided dice, comprising:

a first die having a representation of the number one disposed on two sides, a representation of the number two disposed on two sides, and a representation of the number three disposed on two sides;

a second die having a representation of the number zero disposed on two sides, a representation of the number three disposed on two sides, and a representation of the number six disposed on two sides and, wherein if said two dice are rolled, the resulting numerical total of said two dice being one of the numbers one through nine, with each number one through nine having an equal 0.111 probability of being produced.

* * * * *